US011629877B2

(12) United States Patent
Byeon et al.

(10) Patent No.: US 11,629,877 B2
(45) Date of Patent: Apr. 18, 2023

(54) AIR CONDITIONER AND METHOD FOR CONTROLLING THE AIR CONDITIONER THEREOF CUSTOMIZED FOR A PET

(71) Applicant: Samsung Electronics Co., Ltd., Suwon-si (KR)

(72) Inventors: Nayeong Byeon, Suwon-si (KR); Eumoon Jung, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 17/079,335

(22) Filed: Oct. 23, 2020

(65) Prior Publication Data

US 2021/0123627 A1 Apr. 29, 2021

(30) Foreign Application Priority Data

Oct. 25, 2019 (KR) ..... 10-2019-0134020

(51) Int. Cl.
*F24F 11/65* (2018.01)
*F24F 11/52* (2018.01)
(Continued)

(52) U.S. Cl.
CPC ..... *F24F 11/65* (2018.01); *F24F 11/52* (2018.01); *F24F 2110/10* (2018.01); *F24F 2110/20* (2018.01); *F24F 2120/10* (2018.01)

(58) Field of Classification Search
CPC ..... F24F 11/65; F24F 11/52; F24F 2110/20; F24F 2120/10; F24F 2110/10; F24F 11/30; G05B 15/02
See application file for complete search history.

(56) References Cited

U.S. PATENT DOCUMENTS

2010/0289643 A1* 11/2010 Trundle ..... G05B 15/02 340/3.1
2013/0245837 A1* 9/2013 Grohman ..... F24F 11/30 700/276
2015/0247647 A1* 9/2015 Kusukame ..... H04N 5/33 700/299

(Continued)

FOREIGN PATENT DOCUMENTS

CN 107750984 A 3/2018
CN 209042652 U 6/2019

(Continued)

OTHER PUBLICATIONS

Lambert, Fred. Tesla starts pushing fix to its 'Dog Mode' in incredible turnaround. Electrek [retrieved Sep. 20, 2021]. Retrieved from the Internet <URL: https://electrek.co/2019/08/02/tesla-pushing-fix-dog-mode/> (Year: 2019).*

(Continued)

*Primary Examiner* — Alicia M. Choi

(57) ABSTRACT

An air conditioner is disclosed. The air conditioner includes a communicator, a memory including at least one instruction, and a processor configured to be connected to the communicator and the memory and control the air conditioner. The processor, by executing the at least one instruction, is configured to obtain information regarding a pet via the communicator, obtain an event for entering a pet mode, and based on the air conditioner entering the pet mode according to the event, control the air conditioner according to a first set value of the air conditioner corresponding to the pet based on the obtained information.

13 Claims, 12 Drawing Sheets

(51) Int. Cl.

| | |
|---|---|
| *F24F 120/10* | (2018.01) |
| *F24F 110/20* | (2018.01) |
| *F24F 110/10* | (2018.01) |

(56) References Cited

U.S. PATENT DOCUMENTS

| | | | | |
|---|---|---|---|---|
| 2015/0342143 | A1* | 12/2015 | Stewart | A01K 29/00 119/51.02 |
| 2016/0353705 | A1* | 12/2016 | Weiss | F24F 11/64 |
| 2017/0045864 | A1* | 2/2017 | Fadell | G08B 29/02 |
| 2017/0075510 | A1* | 3/2017 | Bentz | G06Q 20/102 |
| 2017/0108236 | A1* | 4/2017 | Guan | G05B 19/042 |
| 2018/0313565 | A1* | 11/2018 | Mahar | G05D 23/1904 |
| 2019/0021290 | A1* | 1/2019 | Chu | A01K 5/0114 |
| 2019/0309975 | A1* | 10/2019 | Salem | F24F 11/72 |
| 2020/0281165 | A1* | 9/2020 | Heintzelman | A01K 29/005 |

FOREIGN PATENT DOCUMENTS

| | | | | | |
|---|---|---|---|---|---|
| JP | 2006-042670 | A | | 2/2006 | |
| JP | 2010-145067 | A | * | 7/2010 | F24F 11/02 |
| JP | 2010-145067 | A | | 7/2010 | |
| JP | 2017-198393 | A | * | 11/2017 | F24F 11/02 |
| JP | 2018064471 | A | * | 4/2018 | A01K 67/00 |
| JP | 2019-070520 | A | | 5/2019 | |
| KR | 10-0653775 | B1 | | 11/2006 | |
| KR | 10-2017-0003154 | A | | 1/2017 | |
| KR | 20-2018-0002408 | U | | 8/2018 | |
| KR | 10-2019-0079720 | A | | 7/2019 | |
| WO | 2014/172149 | A1 | | 10/2014 | |
| WO | WO-2018/039899 | | * | 3/2019 | |

OTHER PUBLICATIONS

Korosec, Kirsten. Tesla 'Dog mode' and 'Sentry mode' are now live to guard your car and pets. TechCrunch [retrieved Sep. 20, 2021]. Retrieved from the Internet <URL: https://techcrunch.com/2019/02/13/tesla-dog-mode-and-sentry-mode-are-now-live-to-guard-your-car-and-pets/> (Year: 2019).*

International Search Report and Written Opinion of the International Searching Authority in connection with International Application No. PCT/KR2020/014425 dated Feb. 18, 2021, 9 pages.

* cited by examiner

FIG. 5

| TYPE | | SIZE | HAIR LENGTH | SET TEMPERATURE | SET HUMIDITY | OPERATING MODE |
|---|---|---|---|---|---|---|
| CATEGORY | SUBCATEGORY | | | | | |
| DOG | CHIHUAHUA | LARGE | LONG HAIR | 26.5 | 50% | COOLING + DEHUMIDIFICATION + AIR PURIFICATION |
| | | | SHORT HAIR | 27.0 | 55% | COOLING + DEHUMIDIFICATION + AIR PURIFICATION |
| | | MEDIUM | LONG HAIR | 27.0 | 50% | COOLING + DEHUMIDIFICATION + AIR PURIFICATION |
| | | | SHORT HAIR | 27.5 | 55% | COOLING + DEHUMIDIFICATION + AIR PURIFICATION |
| | | SMALL | LONG HAIR | 27.5 | 50% | COOLING (WINDLESS) + DEHUMIDIFICATION + AIR PURIFICATION |
| | | | SHORT HAIR | 28.0 | 55% | COOLING (WINDLESS) + DEHUMIDIFICATION (WINDLESS) + AIR PURIFICATION |
| | SIBERIAN HUSKY | LARGE | LONG HAIR | 24.0 | 45% | COOLING + DEHUMIDIFICATION + AIR PURIFICATION |
| | | | SHORT HAIR | 24.5 | 50% | COOLING + DEHUMIDIFICATION + AIR PURIFICATION |
| | | MEDIUM | LONG HAIR | 24.5 | 45% | COOLING + DEHUMIDIFICATION + AIR PURIFICATION |
| | | | SHORT HAIR | 25.0 | 50% | COOLING + DEHUMIDIFICATION + AIR PURIFICATION |
| | | SMALL | LONG HAIR | 25.5 | 45% | COOLING (WINDLESS) + DEHUMIDIFICATION + AIR PURIFICATION |
| | | | SHORT HAIR | 26.0 | 50% | COOLING (WINDLESS) + DEHUMIDIFICATION (WINDLESS) + AIR PURIFICATION |

FIG. 6

| | PET INFORMATION | SET TEMPERATURE | SET HUMIDITY | OPERATING MODE |
|---|---|---|---|---|
| FIRST SET VALUE | DOG/CHIHUAHUA/ LARGE/LONG HAIR | 26.5 | 50% | COOLING + DEHUMIDIFICATION + AIR PURIFICATION |
| SECOND SET VALUE | DOG/CHIHUAHUA/ LARGE/LONG HAIR | 27 | 60% | COOLING + AIR PURIFICATION |
| THIRD SET VALUE | DOG/CHIHUAHUA/ LARGE/LONG HAIR | 27.5 | 55% | COOLING + AIR PURIFICATION |

AIR CONDITIONER AND METHOD FOR CONTROLLING THE AIR CONDITIONER THEREOF CUSTOMIZED FOR A PET

CROSS-REFERENCE TO RELATED APPLICATION

This application is based on and claims priority under 35 U.S.C. § 119 to Korean Patent Application No. 10-2019-0134020 filed on Oct. 25, 2019 in the Korean Intellectual Property Office, the disclosure of which is incorporated by reference herein in its entirety.

BACKGROUND

1. Field

The disclosure relates to an air conditioner and more particularly relates to an air conditioner for a pet and a control method of the same.

2. Description of Related Art

Along with improvement in standards of living, the number of households having pets has been increased. Accordingly, development for an electronic device for a pet has been increased. For example, there are various devices such as an automatic feeder for automatically feeding on time, when a person leaves a house, a camera associated with a mobile terminal to confirm a state of a pet from the outside, and the like.

An air conditioner such as a cooler has become a daily necessity. However, the air conditioners of the related art provides only cooling modes considering cooling tendencies of a user. Thus, needs for an air conditioner providing an air conditioned environment customized for a pet living with the user.

SUMMARY

The disclosure is made in view of the above needs and an object of the disclosure is to provide an air conditioner controlling an air conditioner according to characteristics of a pet based on information regarding the pet and a method for controlling the same.

In accordance with an aspect of the disclosure, there is provided an air conditioner including: a communicator, a memory including at least one instruction, and a processor configured to be connected to the communicator and the memory and control the air conditioner, in which the processor, by executing the at least one instruction, is configured to obtain information regarding a pet via the communicator, detect an event for entering a pet mode, and based on the air conditioner entering the pet mode according to the event, control the air conditioner according to a first set value of the air conditioner corresponding to the pet based on the obtained information.

In accordance with another aspect of the disclosure, there is provided a method for controlling an air conditioner, the method including obtaining information regarding a pet, detecting an event for entering a pet mode, and based on the air conditioner entering the pet mode according to the event, operating the air conditioner according to a first set value of the air conditioner corresponding to the pet based on the obtained information.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts:

FIG. 5 illustrates a diagram illustrating set values of the air conditioner corresponding to the pet according to an embodiment;

FIG. 6 illustrates a diagram illustrating a method for updating the set value of the air conditioner corresponding to the pet according to an embodiment;

DETAILED DESCRIPTION

Figure 1:
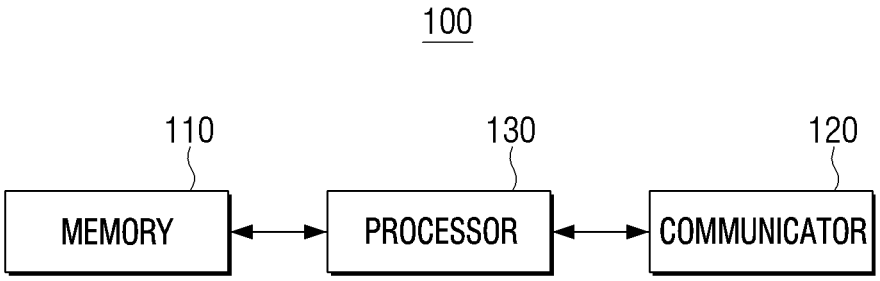
FIG. 1 illustrates a block diagram schematically illustrating a configuration of an air conditioner according to an embodiment.

FIGS. 1 through 11, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Hereinafter, various embodiments of the disclosure will be described with reference to the accompanying drawings. It should be noted that the technologies disclosed in this disclosure are not for limiting the scope of the disclosure to a specific embodiment, but they should be interpreted to include all modifications, equivalents and/or alternatives of the embodiments of the disclosure. In relation to explanation of the drawings, similar reference numerals may be used for similar elements.

In this disclosure, the terms such as "comprise", "may comprise", "consist of", or "may consist of" are used herein to designate a presence of corresponding features (e.g., constituent elements such as number, function, operation, or part), and not to preclude a presence of additional features.

In this disclosure, expressions such as "A or B", "at least one of A [and/or] B,", or "one or more of A [and/or] B," include all possible combinations of the listed items. For example, "A or B", "at least one of A and B,", or "at least one of A or B" includes any of (1) at least one A, (2) at least one B, or (3) at least one A and at least one B.

The expressions "first," "second" and the like used in the disclosure may denote various elements, regardless of order and/or importance, and may be used to distinguish one element from another, and does not limit the elements.

If it is described that a certain element (e.g., first element) is "operatively or communicatively coupled with/to" or is "connected to" another element (e.g., second element), it should be understood that the certain element may be connected to the other element directly or through still another element (e.g., third element). On the other hand, if it is described that a certain element (e.g., first element) is "directly coupled to" or "directly connected to" another element (e.g., second element), it may be understood that there is no element (e.g., third element) between the certain element and the another element.

Also, the expression "configured to" used in the disclosure may be interchangeably used with other expressions such as "suitable for," "having the capacity to," "designed to," "adapted to," "made to," and "capable of," depending on cases. Meanwhile, the expression "configured to" does not necessarily refer to a device being "specifically designed to" in terms of hardware. Instead, under some circumstances, the expression "a device configured to" may refer to the device being "capable of" performing an operation together with another device or component. For example, the phrase "a unit or a processor configured (or set) to perform A, B, and C" may refer, for example, and without limitation, to a dedicated processor (e.g., an embedded processor) for performing the corresponding operations, a generic-purpose processor (e.g., a central processing unit (CPU) or an application processor), or the like, that can perform the corresponding operations by executing one or more software programs stored in a memory device.

An air conditioner according to various embodiments of the disclosure may refer to a device performing operations such as cooling, heating, purification, and the like of the air and may include, for example, at least one of a residential air conditioner, an air conditioner, a ceiling-mounted air conditioner, a car air conditioner, a dehumidifier, a cold air blower, and an air purifier. In this disclosure, a term "user" may refer to a person using the air conditioner or an apparatus (e.g., an artificial intelligence electronic apparatus) using the air conditioner.

FIG. 1 illustrates a block diagram schematically illustrating a configuration of an air conditioner according to an embodiment. Referring to FIG. 1, an air conditioner 100 may include a memory 110, a communicator 120, and a processor 130. The configuration illustrated in FIG. 1 is an example for implementing the embodiment of the disclosure and suitable hardware/software configuration apparent to those skilled in the art may be additionally included to the air conditioner 100 or the configuration illustrated in FIG. 1 may be omitted.

The memory 110 may store an instruction or data related to at least one of other elements of the air conditioner 100. Particularly, the memory 110 may be implemented as a non-volatile memory, a volatile memory, a flash memory, a hard disk drive (HDD), or a solid state drive (SSD). The memory 110 may be accessed by the processor 130 and reading, recording, editing, deleting, or updating of the data by the processor 130 may be executed. A term, memory, in the disclosure may include the memory 110, a ROM (not illustrated) and RAM (not illustrated) in the processor 130, or a memory card (not illustrated) (e.g., micro SD card or memory stick) mounted on the air conditioner 100.

Particularly, the memory 110 may store information regarding a pet. The information regarding a pet may be information necessary to provide an air conditioned environment suitable for a pet mode according to the disclosure. For example, the information regarding a pet may include at least one of a type, an age, a breed, a size, or a hair length of a pet.

The memory 110 may store a set value of the air conditioner 100 corresponding to the information regarding the pet. Specifically, the processor 130 may identify set value information corresponding to the information regarding the pet received via the communicator 120 and store the set value information in the memory 110.

The communicator 120 may communicate with another external device. Particularly, the communicator 120 may receive the information regarding the pet from a user device. The user device according to the disclosure may be an electronic device such as a smartphone or a remote controller which is able to provide various UIs to the user.

The communicator 120 may communicate with various types of external devices according to various types of the communication methods. The communicator 120 may include at least one of a Wi-Fi module, a Bluetooth module, a wireless communication module, an IR module, and a Zigbee module. For example, if the user device is a smartphone, the communicator 120 may communicate with the user device via the Bluetooth module or the Wi-Fi module, and if the user device is a remote controller, the communicator 120 may communicate with the user device via the IR module.

The processor 130 may communicate with the user device or various other external devices using the communicator 120. In addition, the communicator 120 may communicate with the user device or the external device via various communication modules such as the Wi-Fi module.

The processor 130 may be electrically connected to the memory 110 and the communicator 120 to control general operations and functions of the air conditioner.

The processor 130 may be formed of one or a plurality of processors. The one or the plurality of processors may be a general-purpose processor such as a central processing unit (CPU) or an application processor (AP), a graphics dedicated processor such as a graphics processing unit (GPU) or a visual processing unit (VPU), or an artificial intelligence dedicated processor such as a neural processing unit (NPU), or the like.

In particular, the processor 130 may control the air conditioner 100 according to the set value of the air conditioner corresponding to the information regarding the pet using various programs (or instructions) stored in the memory 110.

The processor 130 may obtain the information regarding the pet. Specifically, when the information regarding the pet input via a first UI displayed on the user device is received from the user device, the processor 130 may obtain the information regarding the pet. The first UI may include a UI element for selecting at least one of the type, the breed, the size, and the hair length of the pet for obtaining the information regarding the pet. The first UI for obtaining the information regarding the pet will be described later in detail with reference to FIGS. 3A and 3B. In addition, when the air conditioner 100 further includes an output unit and an input unit which will be described below with reference to FIG. 11, the processor 130 may obtain the information regarding the pet via a UI displayed on the output unit.

The processor 130 may detect an event for entering a pet mode. The event for entering the pet mode may be an event occurring when it is the time corresponding to set information based on the set information for entering the pet mode, an event occurring when only a pet is appearing via a camera in a house, and an event occurring when an input of a user on an external device connected to the air conditioner 100 via the IOT system is not detected for a predetermined period of time.

For example, when the set information regarding time for entering the pet mode is input via the first UI displayed on the user device, the processor 130 may obtain the set information regarding time for entering the pet mode together with the information regarding the pet. The set information may include information regarding the time for entering the pet mode and information regarding the time for ending the pet mode. The set information regarding the time will be described below in detail with reference to FIG. 4. When it is the time corresponding to the set information, the processor 130 may identify that the event for entering the pet mode is detected. In other words, the event for entering the pet mode may occur, when it is the time corresponding to the set information.

For example, when an image received from a camera located in a house where the air conditioner 100 is installed is analyzed and it is found that the pet is in the house alone, the processor 130 may identify that the event for entering the pet mode is detected. The embodiment for entering the pet mode via the camera will be described below in detail with reference to FIG. 5.

For example, when the input of the user to the external device connected to the air conditioner 100 via the IOT system is not detected for a predetermined period of time, the air conditioner 100 may identify that the event for entering the pet mode is detected. The embodiment for entering the pet mode when the input of the user to the external device is not detected for the predetermined period of time will be described below in detail with reference to FIG. 6.

When the event for entering the pet mode is detected and the air conditioner enters the pet mode, the processor 130 may control the air conditioner according to a first set value of the air conditioner 100 corresponding to the pet based on the information regarding the pet obtained via the communicator 120. The first set value may be a set value for setting a set humidity, a set temperature, and an operating mode of the air conditioner 100 according to the information regarding the pet, and the operating mode may be a cooling mode, a dehumidification mode, and an air purification mode but is not limited thereto. In other words, the first set value may be a set value for providing an air conditioned environment suitable for the pet corresponding to the information regarding the pet.

The processor 130 may receive a user input for controlling the air conditioner 100 while the air conditioner 100 is operated according to the first set value. The user input for controlling the air conditioner 100 may be a user input for changing at least one of a set humidity, a set temperature, and an operating mode of the air conditioner 100. In addition, the user input may be a user input for turning the air conditioner 100 off. However, the user input is not limited thereto and may include various inputs for controlling other settings of the air conditioner 100. Specifically, the user input may include a user input that is input via a UI for controlling the air conditioner 100 of the user device and a user input that is input via a remote controller of the air conditioner 100, however, a method for receiving the user input is not limited thereto and the air conditioner 100 may directly receive the user input, receive the user input via a user's voice, or receive by various other methods.

The processor 130 may change the set value of the air conditioner 100 to a second set value according to the received user input and control the air conditioner 100 according to the second set value. In other words, while the air conditioner 100 is operated according to the first set value set based on the information regarding the pet, when a user command for controlling the air conditioner 100 is received, the processor 130 may control the air conditioner 100 according to the second set value reflecting the user input.

The processor 130 may update the set value corresponding to the pet from the first set value to the second set value. According to an embodiment of the disclosure, the set value may be updated for each time the input of the user for controlling the air conditioner 100 is received, the set value may be updated based on the input of the user received at predetermined time interval (e.g., interval of 3 hours), or the set value may be updated, when the number of times of input of the user for controlling the air conditioner 100 exceeds a threshold value (e.g., 5 times).

In addition, according to an embodiment of the disclosure, the processor 130 may obtain indoor environment information in a house or an outdoor environment information. Specifically, when the air conditioner 100 further includes a sensor (not illustrated), the processor 130 may obtain the indoor environment information via the sensor. For example, the indoor environment information may include information regarding a temperature and information regarding a humidity in the house. The processor 130 may receive the outdoor environment information via the communicator 120. For example, the outdoor environment information may include information regarding a weather report for the outdoor environment of the house.

When a command for entering the pet mode via the notification UI displayed on the user device based on the indoor environment information and the outdoor environment information is obtained from the user device, the processor 130 may enter the pet mode. The event for entering the pet mode may be a pet mode entering command of the user for the notification UI. In other words, the notification UI for entering the pet mode may be displayed on the user device based on the indoor environment information and the outdoor environment mode. In an embodiment of the disclosure, the notification UI may be displayed on the user device, if the indoor environment of the house is beyond a threshold humidity range and a threshold temperature range for the pet. The threshold humidity range and the threshold temperature range for the pet may be preset based on the type, the breed, the size, the hair length, and the like of the pet, and the threshold humidity range and the threshold temperature range may be set according to the information regarding the pet input by the user. For example, if the type of the pet is a dog, the threshold temperature range may be 10 degrees to 29.5 degrees Celsius and the threshold humidity range may be 30% to 70%.

In addition, the notification UI may be displayed on the user device according to the outdoor environment information such as a weather report. In an embodiment of the disclosure, if a weather report such as drought warning or heat wave warning is issued, the notification UI for entering the pet mode may be displayed on the user device.

The processor 130 may receive a command for entering the pet mode from the user device via the notification UI displayed on the user device via the communicator 120. When the command for entering the pet mode is received from the user device via the communicator 120, the processor 130 may enter the pet mode. The notification UI for entering the pet mode will be described below in detail with reference to FIG. 10.

According to various embodiments of the disclosure described above, the air conditioner may provide the air conditioned environment reflecting the characteristics of the pets. In addition, according to various embodiments of the disclosure, the air conditioner may provide the air conditioned environment more suitable for the pet by changing the set values of the air conditioner according to the input of the user for controlling the air conditioner while the pet mode is operated.

Figure 2:
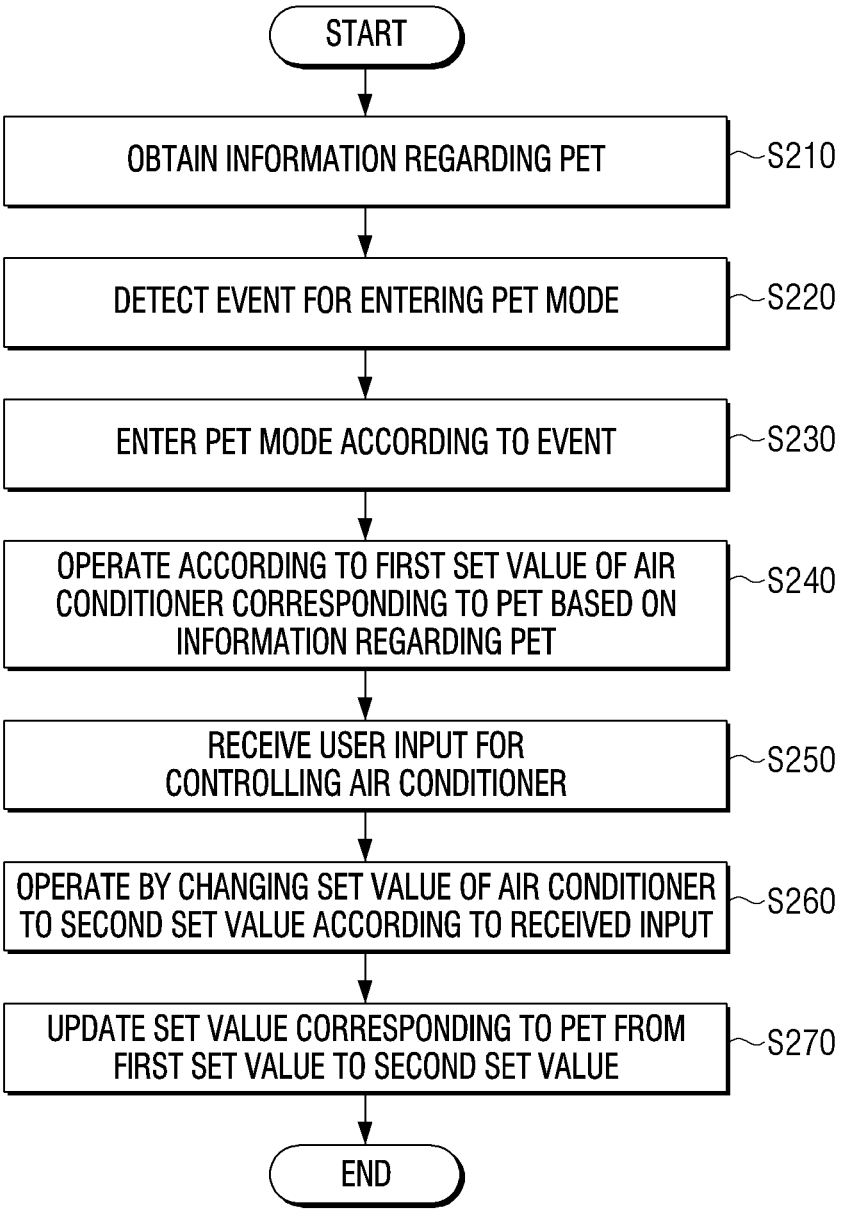
FIG. 2 illustrates a flowchart for illustrating a method for controlling the air conditioner according to an embodiment.

FIG. 2 illustrates a flowchart for illustrating a method for controlling the air conditioner according to an embodiment.

Figure 3A:
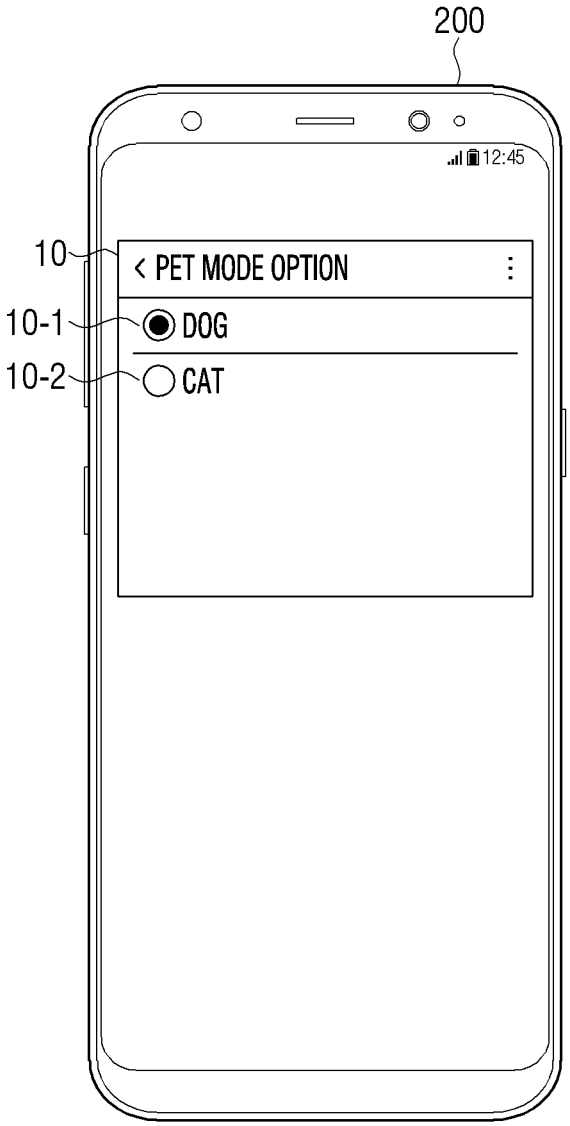
FIG. 3A illustrates a diagram illustrating a UI for selecting a type of a pet according to an embodiment.

Firstly, the air conditioner 100 may obtain the information regarding the pet (S210). The information regarding the pet may include at least one of the type, the breed, the size, and the hair length of the pet. According to an embodiment of the disclosure, the air conditioner may obtain the information regarding the pet by receiving the information regarding the pet input via the first UI displayed on an external device from the external device. Referring to FIG. 3A, the air conditioner 100 may obtain the information regarding the pet via a UI 10 displayed on a user device 200. The UI 10 of FIG. 3A may display UI elements 10-1 and 10-2 for selecting the type of the pet. In other words, if the pet is a dog, the UI element 10-1 for the dog may be selected by the user on the UI 10, and if the pet is a cat, the UI element 10-2 for the cat may be selected by the user on the UI 10. FIG. 3A illustrates that the number of types of the pet is two, dog and cat, on the UI 10, but there is no limitation thereto, and a UI element for a type of any animal corresponding to the pet may be further displayed.

Figure 3B:
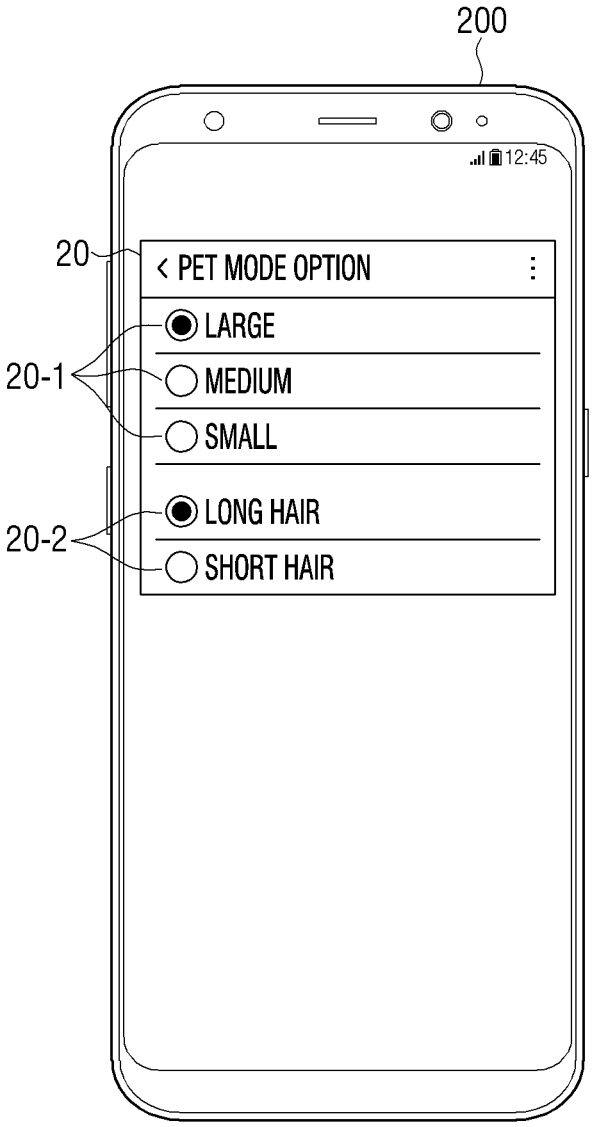
FIG. 3B illustrates a diagram illustrating a UI for selecting a size or a length of hair of the pet according to an embodiment.

When the type of the pet is selected on the UI 10 of FIG. 3A, a UI 20 for selecting the characteristics of the pet may be displayed as illustrated in FIG. 3B. In other words, information regarding the size of the pet may be input by the user via a UI element 20-1 for inputting the size of the pet, and information regarding the hair length of the pet may be input by the user via a UI element 20-2 for inputting the hair length of the pet. It is illustrated that the UI 20 of FIG. 3B includes only the UI elements 20-1 and 20-2 for inputting the size and the hair length of the pet, but there is no limitation thereto, and the UI 20 may further include a UI element for inputting the breed of the pet or a UI element for inputting the age of the pet. In other words, the air conditioner 100 may obtain the information regarding the pet via the UI 10 of FIG. 3A and the UI 20 of FIG. 3B.

The air conditioner 100 may detect the event for entering the pet mode (S220). In other words, if the event for entering the pet mode is detected, the air conditioner 100 may enter the pet mode. The event for entering the pet mode may be an event occurring when it is the time corresponding to set information based on the set information for entering the pet mode, an event occurring when only a pet is appearing via a camera in a house, and an event occurring when an input of a user on an external device connected to the air conditioner 100 via the IOT system is not detected for a predetermined period of time.

Figure 4:
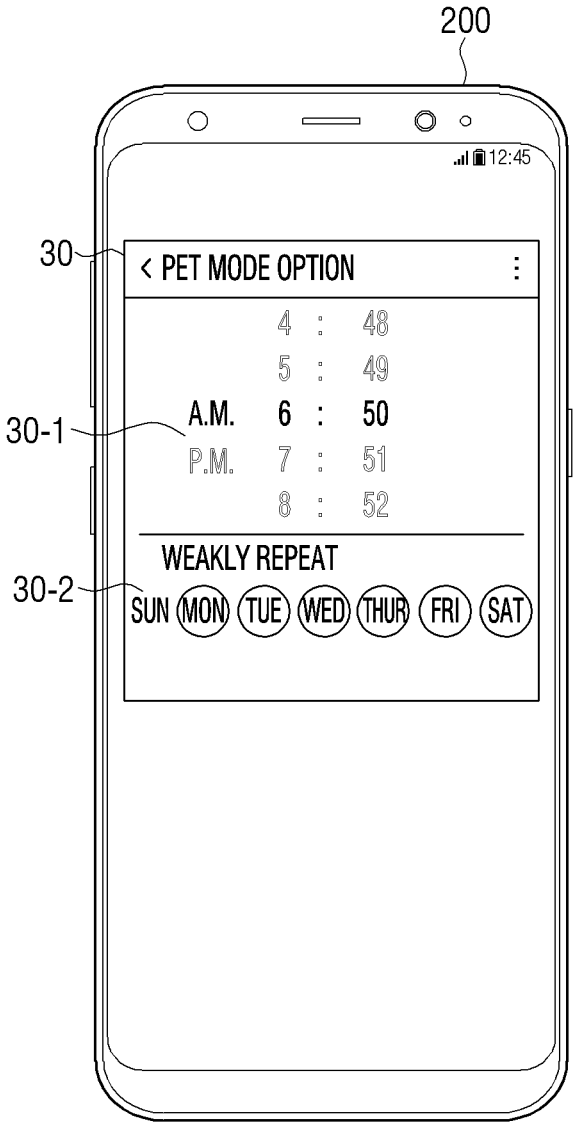
FIG. 4 illustrates a diagram illustrating a UI for setting a time for entering the pet mode according to an embodiment.

According to an embodiment of the disclosure, the air conditioner 100 may obtain information regarding the time for entering the pet mode via a UI displayed on the user device. Referring to FIG. 4, the air conditioner 100 may obtain the information regarding the time for entering the pet mode via a UI 30 displayed on the user device 200. The UI 30 of FIG. 4 may display a UI element 30-1 for setting the time for the air conditioner 100 to enter the pet mode. In other words, referring to FIG. 4, if the set time for entering the pet mode is set as 6:50 a.m. via the UI element 30-1, the air conditioner 100 may enter the pet mode when it is 6:50 a.m. In addition, information regarding the time for ending the pet mode may also be input via the UI element 30-1.

Further, the UI 30 of FIG. 4 may display a UI element 30-2 for setting a day for entering the pet mode at the time set via the UI element 30-1 for setting the time for entering the pet mode. In other words, if the days except for Sunday are selected via the UI element 30-2 for setting the day, the air conditioner 100 may enter the pet mode at the time set via the UI element 30-1 on the days except for Sunday.

When it is the time corresponding to the set information, the air conditioner 100 may identify that the event for entering the pet mode is detected. In other words, the event for entering the pet mode may occur, when it is the time corresponding to the set information.

In addition, according to an embodiment of the disclosure, when an image received from a camera located in the house is analyzed and it is found that the pet is in the house alone, the air conditioner 100 may identify that the event for entering the pet mode is detected.

Further, according to an embodiment of the disclosure, when the input of the user to the external device connected to the air conditioner 100 via the IOT system is not detected for a predetermined period of time, the air conditioner 100 may identify that the event for entering the pet mode is detected.

When the event for entering the pet mode is detected, the air conditioner 100 may enter the pet mode according to the event (S230) and operate according to the first set value of the air conditioner 100 corresponding to the pet based on the information regarding the pet. The first set value may be a set value for setting a set humidity, a set temperature, and an operating mode of the air conditioner 100 according to the information regarding the pet, and the operating mode may be a cooling mode, a dehumidification mode, and an air purification mode but is not limited thereto.

Specifically, FIG. 5 illustrates a diagram illustrating set values of the air conditioner corresponding to the pet according to an embodiment. Referring to FIG. 5, when information regarding a first pet indicating that the animal type is a dog, the breed is Chihuahua, the size is medium, and the hair length is long is obtained, the air conditioner 100 may operate according to set values set with a set temperature of 27 degrees, a set humidity of 50%, and an operating mode of cooling+dehumidification+air purification. When information regarding a second pet indicating that the animal type is a dog, the breed is Siberian husky, the size is large, and the hair length is short is obtained, the air conditioner 100 may operate according to set values set with a set temperature of 24.5 degrees, a set humidity of 50%, and an operating mode of cooling+dehumidification+air purification.

According to an embodiment of the disclosure, in a case of obtaining the information regarding a plurality of pets, the air conditioner 100 may operate according to an average value of the set values corresponding to each of the plurality of pets. In other words, when the information regarding the first pet and the second pet is obtained, the air conditioner 100 may operate according to set values set with a set temperature of 26 degrees, a set humidity of 50%, and an operating mode of cooling+dehumidification+air purification.

The set values of the air conditioner 100 corresponding to the pet illustrated in FIG. 5 may be obtained from an external server via the communicator or may be stored in advance in the memory of the air conditioner 100.

The air conditioner 100 may receive a user input for controlling the air conditioner 100 (S250). The user input for controlling the air conditioner 100 may be a user input for changing at least one of the set humidity, the set temperature, and the operating mode of the air conditioner 100. In addition, the user input may be a user input for turning the air conditioner 100 off.

The air conditioner 100 may operate by changing the set value of the air conditioner to the second set value according to the received input (S260). In other words, when the user command for controlling the air conditioner 100 is received while the air conditioner 100 operates according to the first set value set based on the information regarding the pet, the air conditioner 100 may operate the air conditioner 100 according to the second set value reflecting the user input. The air conditioner 100 may update the set value corresponding to the pet from the first set value to the second set value (S270). When the user input for controlling the air conditioner 100 is received while the air conditioner 100 operates according to the first set value, the air conditioner may operate according to the second set value reflecting the received input. The air conditioner 100 may update the first set value to the second set value according to the received user input.

Specifically, referring to the example of FIG. 6, when information regarding a third pet indicating that the animal type is a dog, the breed is Chihuahua, the size is large, and the hair length is long is obtained, the air conditioner 100 may operate according to first set values set with a set temperature of 26.5 degrees, a set humidity of 50%, and an operating mode of cooling+dehumidification+air purification. Then, when the set temperature of the air conditioner 100 is changed from 26.5 degrees to 27 degrees, the set humidity is changed to 50% to 60%, and the dehumidification mode is turned off by the user, the air conditioner 100 may update the first set values set with a set temperature of 26.5 degrees, a set humidity of 50%, and an operating mode of cooling+dehumidification+air purification to second set values set with a set temperature of 27 degrees, a set humidity of 60%, and an operating mode of cooling+air purification.

When the set temperature is changed from 27 degrees to 27.5 degrees and the set humidity is changed from 60% to 55% while the air conditioner 100 operates according to the second set values, the air conditioner 100 may update the second set values set with a set temperature of 27 degrees, a set humidity of 60%, and an operating mode of cooling+air purification to third set values set with a set temperature of 27.5 degrees, a set humidity of 55%, and an operating mode of cooling+air purification.

According to an embodiment of the disclosure, the set value may be updated for each time when the user command for controlling the air conditioner 100 is received, the set value may be updated based on the input of the user received at predetermined time interval, or the set value may be updated, when the number of times of input of the user for controlling the air conditioner 100 exceeds a threshold value.

According to various embodiments of the disclosure described above, the air conditioner may provide the air conditioned environment reflecting the characteristics of the pets.

Figure 7:
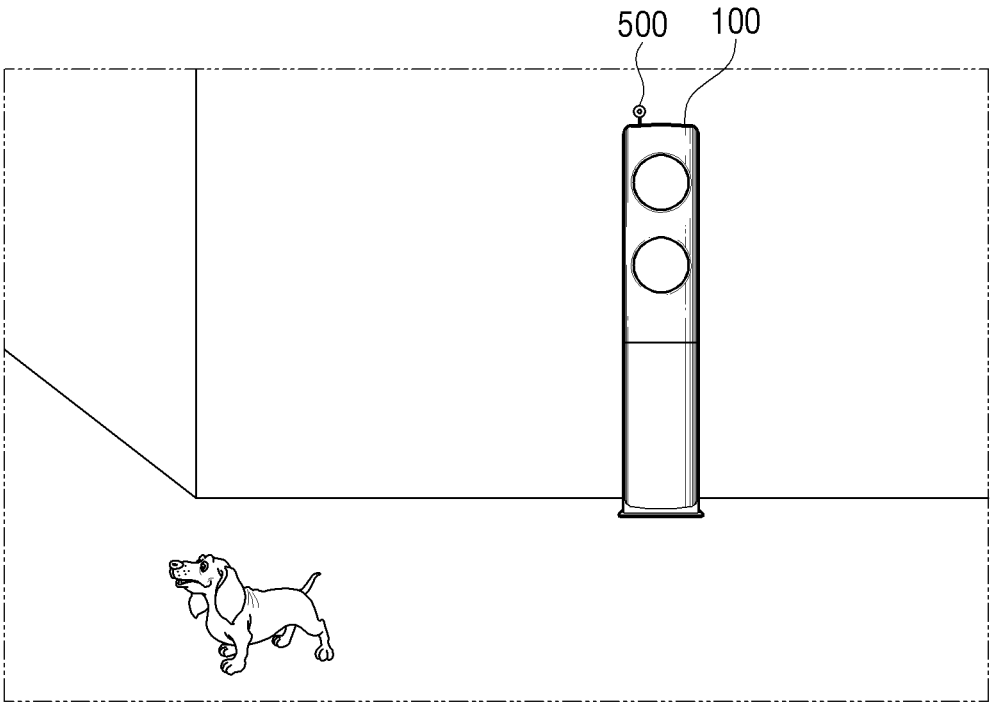
FIG. 7 illustrates a diagram for illustrating a method for entering the pet mode based on a camera in a house according to an embodiment.

FIG. 7 illustrates a diagram for illustrating a method for entering the pet mode based on a camera in a house according to an embodiment.

Referring to FIG. 7, a camera 500 may be installed in the house where the air conditioner 100 is installed. FIG. 7 illustrates that the camera 500 is installed on the air conditioner 100, but there is no limitation thereto, and the camera may be installed on a ceiling or a wall in the house or may be installed on a TV or the like in the house. The camera 500 may capture the inside of the room in real time and the air conditioner 100 may receive the captured image from the camera 500. The air conditioner 100 may analyze the received image to identify whether only the pet is in the house. According to an embodiment, the air conditioner 100 may obtain information regarding a type of an object included in the received image, coordinate information, and information regarding the time when the object is captured, and identify whether only the pet is in the house for a predetermined period of time. Specifically, the information regarding the type of the object may be information regarding whether the object included in the image is a pet or a person. In other words, the air conditioner 100 may identify whether the object included in the image is a pet or a person, and identify whether only the pet is in the house for a predetermined period of time based on the information regarding the time when the identified object is captured. When it is identified that only the pet is in the house for a predetermined period of time, the air conditioner 100 may identify that the event for entering the pet mode is detected and enter the pet mode.

Meanwhile, in the embodiment of FIG. 7, it is described that the air conditioner 100 directly enters the pet mode, when it is identified that only the pet is in the house for a predetermined period of time, but there is no limitation thereto. In other words, when it is identified that only the pet is in the house for a predetermined period of time, a notification for entering the pet mode may be provided to the user device, and the air conditioner 100 may enter the pet mode according to a pet mode entering command of the user corresponding to the notification.

Meanwhile, in the embodiment, the air conditioner 100 analyzes the received image to identify whether only the pet is in the house, but this is merely an embodiment, and the external server or the camera 500 may analyze the received image to identify whether only the pet is in the house, and a result identified by the external server or the camera 500 may be transmitted to the air conditioner 100.

Figure 8:
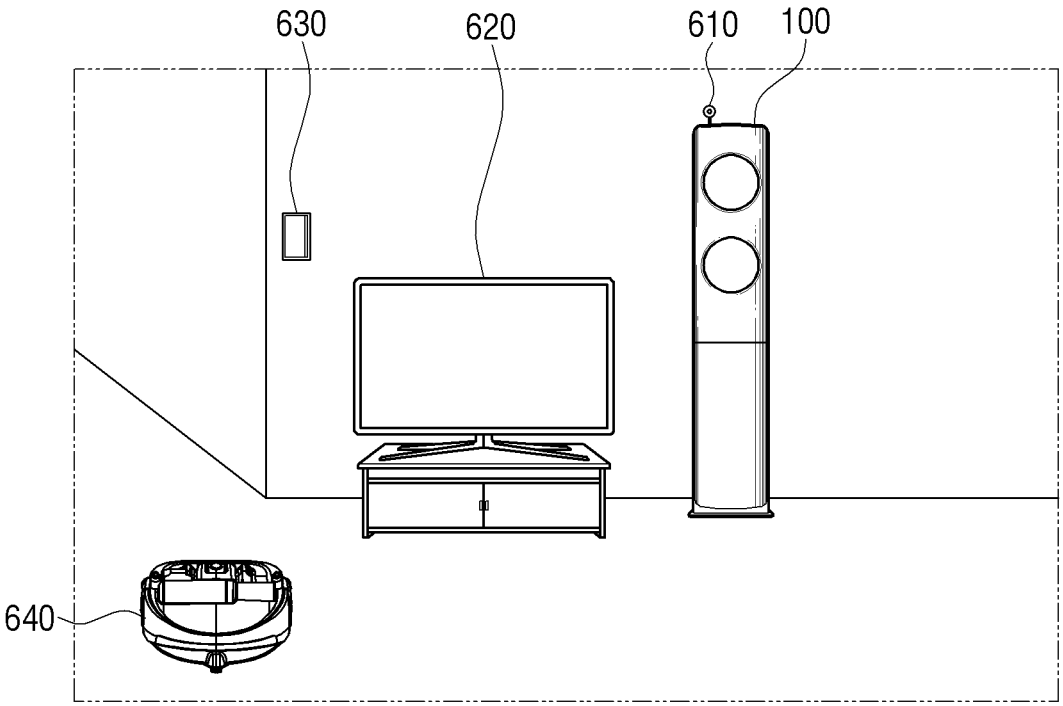
FIG. 8 illustrates a diagram for illustrating a method for entering the pet mode based on an external device in the house according to an embodiment.

FIG. 8 illustrates a diagram for illustrating a method for entering the pet mode based on an external device in the house according to an embodiment.

According to an embodiment of the disclosure, the air conditioner 100, a camera 610, a TV 620, a smart light switch 630, and a robot cleaner 640 in the house may be connected to each other with the IOT system. In other words, the air conditioner 100, the camera 610, the TV 620, the smart light switch 630, and the robot cleaner 640 in the house may be controlled directly by the user or the air conditioner 100, the camera 610, the TV 620, the smart light switch 630, and the robot cleaner 640 in the house may be controlled via the user device such as a smartphone.

When a control command of the user for the external device such as the camera 610, the TV 620, the smart light switch 630, and the robot cleaner 640 connected to the air conditioner 100 in the house via the IOT system is not detected for a predetermined period of time, the air conditioner 100 may identify that the event for entering the pet mode is detected and enter the pet mode.

In an embodiment, it is described that, when the control command for the user for the external device is not detected for a predetermined period of time, the air conditioner 100 enters the pet mode, but there is no limitation thereto. In other words, when the control command of the user for the external device is not detected for a predetermined period of time, a notification for entering the pet mode may be provided to the user device and the air conditioner 100 may enter the pet mode according to the pet mode entering command of the user corresponding to the notification.

Meanwhile, in the embodiment described above, the air conditioner 100 identifies whether the control command of the user for the external device connected to the air conditioner 100 via the IOT system is detected for a predetermined period of time, but this is merely an embodiment, and the external server or the user device may identify whether the control command of the user for the external device is detected for a certain period of time.

In other words, according to the embodiment described above, the air conditioner may provide the air conditioned environment suitable for the pet by entering the pet mode even while the user leaves the house.

Figure 9:
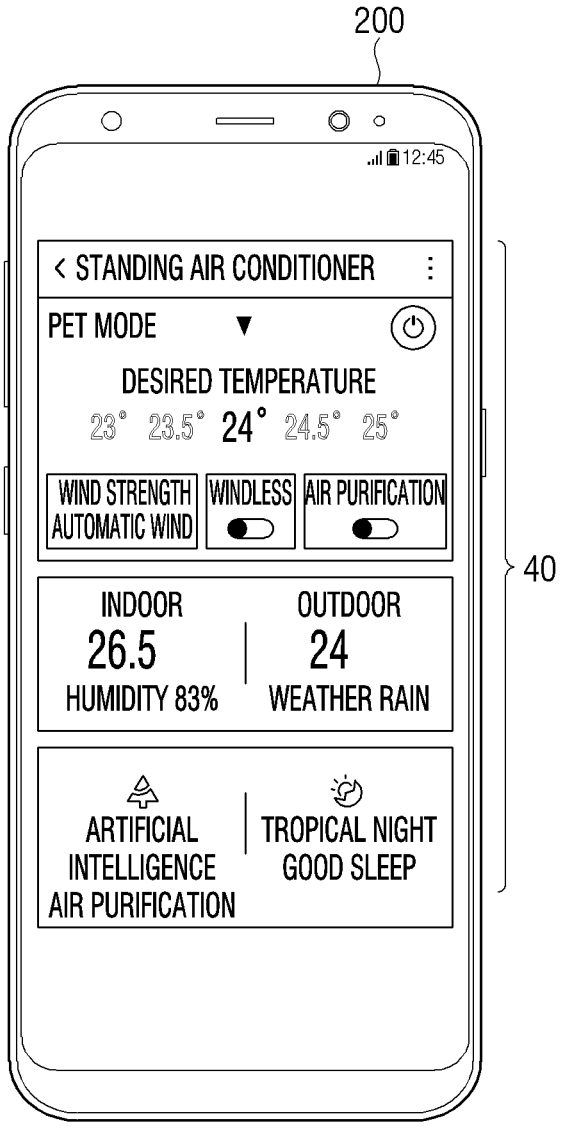
FIG. 9 illustrates a diagram illustrating a UI for controlling the air conditioner according to an embodiment.

FIG. 9 illustrates a diagram illustrating a UI for controlling the air conditioner according to an embodiment.

Referring to FIG. 9, a UI 40 for controlling the air conditioner 100 may be displayed on the user device 200. In other words, while the air conditioner 100 operates in the pet mode, the air conditioner 100 may be controlled via the UI 40 displayed on the user device 200. The air conditioner 100 may receive the user input of the UI 40 displayed on the user device 200 and operate by changing the set values of the air conditioner 100 according to the received user input.

Specifically, when the air conditioner 100 operates in the pet mode, the UI 40 displays a text indicating that the operating mode of the air conditioner 100 is currently the pet mode, and display information regarding first set values corresponding to the pet mode. The first set values may be set values of the air conditioner 100 corresponding to information regarding the pet input by the user. In other words, referring to FIG. 9, the first set values may be set values in which the set temperature (desired temperature) is 24 degrees, the wind strength is set in a windless mode of automatic wind, and an air purification mode is operated.

When the user input for changing the set temperature or the wind strength is received via the UI 40 of the user device 200, the air conditioner 100 may operate according to second set values by changing the set values of the air conditioner 100 to the second set values according to the received user input.

According to an embodiment of the disclosure, when the user input for controlling the air conditioner 100 is received via the UI 40 during the operation in the pet mode, the air conditioner 100 may update the first set values corresponding to the pet mode to the second set values based on the received user input. According to an embodiment of the disclosure, the updating the first set values to the second set values may be performed each time the input of the user for controlling the air conditioner 100 is received, may be performed based on the input of the user received at predetermined time interval, or may be performed, when the number of times of input of the user for controlling the air conditioner 100 exceeds a threshold value.

Figure 10:
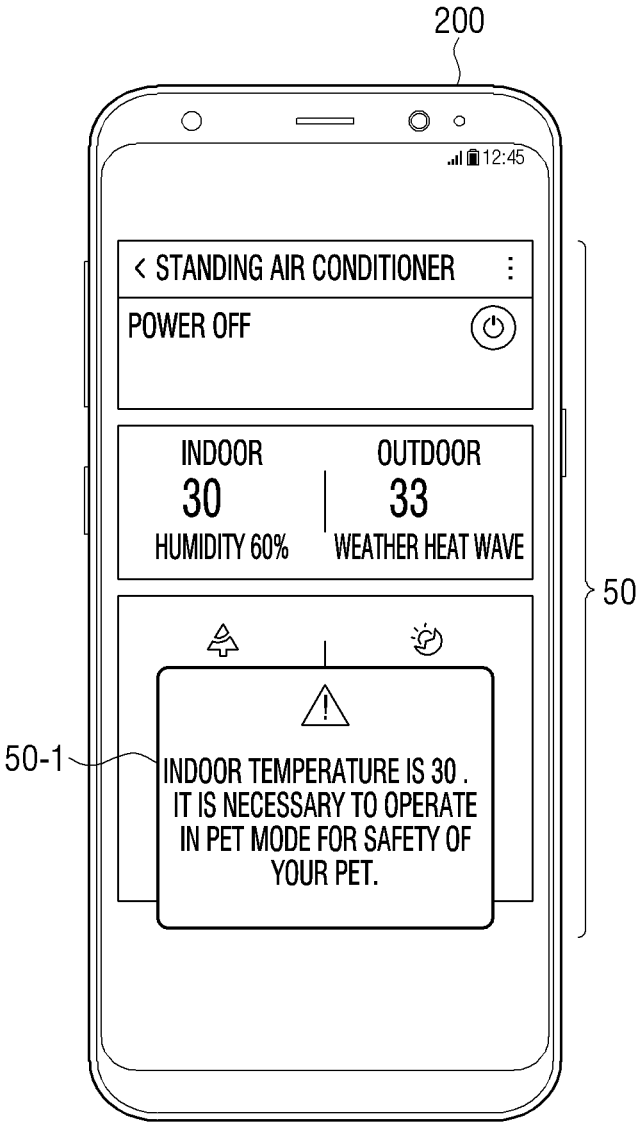
FIG. 10 illustrates a diagram illustrating a notification UI for entering the pet mode provided on a user device according to an embodiment.

FIG. 10 illustrates a diagram illustrating a notification UI for entering the pet mode provided on a user device according to an embodiment.

The air conditioner 100 may obtain the indoor environment information and the outdoor environment information of the house. Specifically, when the air conditioner 100 includes a temperature sensor or a humidity sensor, the indoor environment information may be detected (obtained) using the temperature sensor or the humidity sensor. The air conditioner 100 may obtain the outdoor environment information such as a weather report.

When the indoor environment of the house is beyond a threshold humidity and a threshold temperature corresponding to the pet according to the indoor environment information, a notification UI 50-1 for entering the pet mode may be displayed on the user device 200. The threshold humidity and the threshold temperature ranges corresponding to the pet may be preset according to the type, the breed, the size, the hair length, and the like of the pet, and the threshold humidity range and the threshold temperature range may be set according to the information regarding the pet input by the user.

Referring to FIG. 10, the user device 200 may display the UI 50 for controlling the air conditioner 100 and the UI 50 may indicate a power-off state of the air conditioner 100. In an embodiment, when the threshold temperature range corresponding to the pet is higher than 20 degrees and lower than 30 degrees, the notification UI 50-1 for notifying that the indoor temperature is 30 degrees and it is necessary to operate in the pet mode may be displayed on the user device 200.

The user may identify whether the indoor environment is beyond the threshold humidity range and the threshold temperature range corresponding to the pet by the notification UI 50-1 of the user device 200. In other words, according to the embodiment described above, the air conditioned environment suitable for the pet may be provided by providing the notification for entering the pet mode to the user according to the indoor environment and the outdoor environment.

Figure 11:
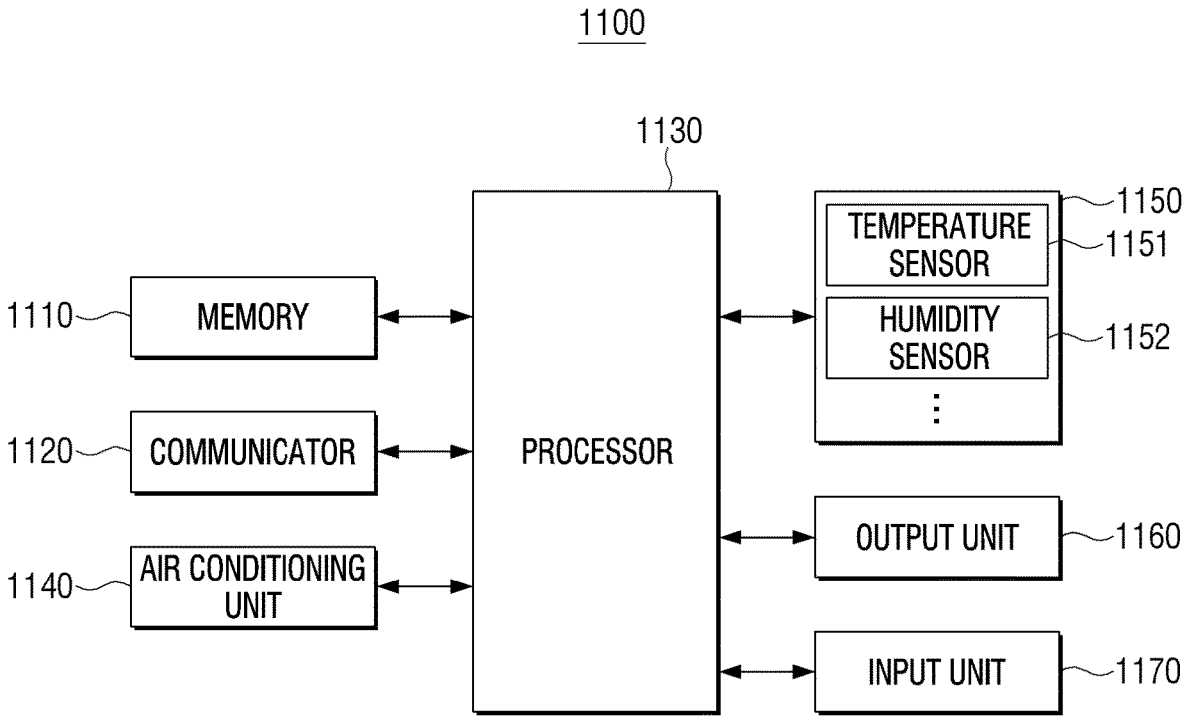
FIG. 11 illustrates a block diagram schematically illustrating a configuration of the air conditioner according to an embodiment.

FIG. 11 illustrates a block diagram schematically illustrating a configuration of the air conditioner according to an embodiment. Referring to FIG. 11, an air conditioner 1100 may include a memory 1110, a communicator 1120, a processor 1130, an air conditioning unit 1140, a sensor 1150, an output unit 1160, and an input unit 1170. Meanwhile, the memory 1110, the communicator 1120, and the processor 1130 have been described in FIG. 1, and therefore the overlapped description will not be repeated.

The air conditioner 1140 may perform a cooling or heating operation of the air conditioner 1100. The air conditioning unit 1140 may perform the cooling or heating operation according to a user command input via a remote controller or a button included in the air conditioner 1100 or a user command input via a UI displayed on the user device.

The air conditioning unit 1140 may operate the cooling or heating operation based on a set temperature, a set humidity, a wind strength, a cooling mode, a humidity mode, and the like according to the user command. In addition, the air conditioner 1140 may also include an outdoor unit, not only the indoor unit of the air conditioner 1100.

The sensor 1150 may obtain various pieces of information of an area where the air conditioner 1100 is located. Referring to FIG. 12, the sensor 1150 may include a temperature sensor 1151, a humidity sensor 1152, and the like, but this is merely an embodiment, and the sensor may include other sensors (e.g., an IR sensor, a proximity sensor, a camera, or the like for detecting the presence of the user). The air conditioner 1100 may obtain information regarding an indoor temperature via the temperature sensor 1151 and may obtain information regarding an indoor humidity via the humidity sensor 1152.

The output unit 1160 may output a message provided by the air conditioner 1100. The output unit 1160 may include a speaker for providing a voice message, a display, and LED, or the like for providing a visual message, but there is no limitation thereto. The message provided by the air conditioner 1100 may be output via the output unit 1160, but is not limited thereto, and the message provided by the air conditioner 1100 may be transmitted to the user device via the communicator 1120 and displayed on the user device in a form of a UI.

The input unit 1170 may receive and transmit the user command to the processor 1130. The input unit 1170 may include a touch sensor, a (digital) pen sensor, a pressure sensor, a key, and the like. The touch sensor may use, for example, at least one type of an electrostatic type, a pressure-sensitive type, an infrared type, or an ultrasonic type. The (digital) pen sensor may be, for example, a part of a touch panel or may include a separate sheet for recognition. The key may include, for example, a physical button, an optical key, or a keypad.

According to various embodiments of the disclosure described above, the air conditioner may operate by reflecting the characteristics of pets.

Various embodiments of the disclosure may be implemented as software including instructions stored in machine (e.g., computer)-readable storage media. The machine is a device which invokes instructions stored in the storage medium and is operated according to the invoked instructions, and may include an electronic device (e.g., air conditioner 100) according to the disclosed embodiments. In a case where the instruction is executed by a processor, the processor may perform a function corresponding to the instruction directly or using other elements under the control of the processor. The instruction may include a code made by a compiler or a code executable by an interpreter. The machine-readable storage medium may be provided in a form of a non-transitory storage medium. Here, the "non-transitory" storage medium is tangible and may not include signals, and it does not distinguish that data is semi-permanently or temporarily stored in the storage medium.

According to an embodiment, the methods according to various embodiments disclosed in this disclosure may be provided to be included in a computer program product. The computer program product may be exchanged between a seller and a purchaser as a commercially available product. The computer program product may be distributed in the form of a machine-readable storage medium (e.g., compact disc read only memory (CD-ROM)) or distributed online through an application store (e.g., PlayStore™). In a case of the on-line distribution, at least a part of the computer program product may be at least temporarily stored or temporarily generated in a storage medium such as a memory of a server of a manufacturer, a server of an application store, or a relay server.

Each of the elements (e.g., a module or a program) according to various embodiments described above may include a single entity or a plurality of entities, and some sub-elements of the abovementioned sub-elements may be omitted or other sub-elements may be further included in various embodiments. Alternatively or additionally, some elements (e.g., modules or programs) may be integrated into one entity to perform the same or similar functions performed by each respective element prior to the integration. Operations performed by a module, a program, or other elements, in accordance with various embodiments, may be performed sequentially, in a parallel, repetitive, or heuristically manner, or at least some operations may be performed in a different order, omitted, or may add a different operation.

Although the present disclosure has been described with various embodiments, various changes and modifications may be suggested to one skilled in the art. It is intended that the present disclosure encompass such changes and modifications as fall within the scope of the appended claims.

What is claimed is:

1. An air conditioner comprising:

a communicator;

a memory including at least one instruction; and a processor coupled to the communicator and the memory and configured to control the air conditioner, wherein the processor, by executing the at least one instruction, is further configured to:

obtain information regarding a pet via the communicator and identify a first set value from a set value corresponding to the pet based on the obtained information;

obtain a first event for entering a pet mode, wherein the first event occurs based on only the pet being in a house by analyzing an image received from a camera located in the house;

based on the air conditioner entering the pet mode according to the first event, determine the first set value from the set value corresponding to the pet based on the obtained information and control a set value of the air conditioner according to the first set value;

receive a first user input for controlling the air conditioner while the air conditioner operates according to the first set value in the pet mode;

change the set value of the air conditioner to a second set value according to the received user input and control the air conditioner according to the second set value;

determine whether a number of times of input of the first user input exceeds a threshold value;

based on the number of times of input of the first user input exceeding the threshold value, update the set value corresponding to the pet from the first set value to the second set value;

end the pet mode based on a second user input;

obtain the first event for entering the pet mode after ending the pet mode; and based on the air conditioner entering the pet mode according to the first event, control the set value of the air conditioner according to the second set value.

2. The air conditioner according to claim 1, wherein:

the first set value is a set value for setting a set humidity, a set temperature, and an operating mode of the air conditioner according to the information regarding the pet, and the first user input is a user input for changing at least one of the set humidity, the set temperature, and the operating mode of the air conditioner.

3. The air conditioner according to claim 1, wherein:

the processor is further configured to receive the information regarding the pet input via a first user interface displayed on a user device via the communicator, and the information regarding the pet comprises at least one of a type, a breed, a size, and a hair length of the pet.

4. The air conditioner according to claim 1, further comprising:

a sensor coupled to the processor and configured to detect indoor environment information, wherein the processor is further configured to:

obtain the indoor environment information of the house based on the sensor and obtain outdoor environment information via the communicator; and based on a command for entering the pet mode input via a notification user interface displayed on a user device and based on the obtained indoor environment information and the outdoor environment information obtained from the user device via the communicator, enter the pet mode.

5. The air conditioner according to claim 4, wherein, based on an indoor environment of the house being beyond a threshold humidity and a threshold temperature range corresponding to the pet according to the obtained indoor environment information, the notification user interface is displayed on the user device.

6. A method for controlling an air conditioner, the method comprising:

obtaining information regarding a pet and identifying a first set value from a set value corresponding to the pet based on the obtained information;

obtaining a first event for entering a pet mode, wherein the first event occurs based on only the pet being in a house by analyzing an image received from a camera located in the house;

based on the air conditioner entering the pet mode according to the first event, determining the first set value from the set value corresponding to the pet based on the obtained information and controlling a set value of the air conditioner according to the first set value;

receiving a first user input for controlling the air conditioner while the air conditioner operates according to the first set value in the pet mode;

operating by changing the set value of the air conditioner to a second set value according to the received user input;

determining whether a number of times of input of the first user input exceeds a threshold value;

based on the number of times of input of the first user input exceeding the threshold value, updating the set value corresponding to the pet from the first set value to the second set value;

end the pet mode based on a second user input;

obtaining the first event for entering the pet mode after ending the pet mode; and based on the air conditioner entering the pet mode according to the first event, controlling the set value of the air conditioner according to the second set value.

7. The method according to claim 6, wherein:

the first set value is a set value for setting a set humidity, a set temperature, and an operating mode of the air conditioner according to the information regarding the pet, and the first user input is a user input for changing at least one of the set humidity, the set temperature, and the operating mode of the air conditioner.

8. The method according to claim 6, wherein:

the obtaining comprises obtaining the information regarding the pet input via a first user interface displayed on a user device from the user device, and the information regarding the pet comprises at least one of a type, a breed, a size, and a hair length of the pet.

9. The method according to claim 6, wherein the entering comprises:

obtaining indoor environment information of the house and outdoor environment information; and based on a command for entering the pet mode input via a notification user interface displayed on a user device based on the obtained indoor environment information and the outdoor environment information being obtained from the user device, entering the pet mode.

10. The method according to claim 9, wherein, based on an indoor environment of the house being beyond threshold humidity and threshold temperature ranges corresponding to the pet according to the obtained indoor environment information, the notification user interface is displayed on the user device.

11. A non-transitory computer readable medium comprising instructions, that when executed by a processor of an air conditioner, cause the air conditioner to:

obtain information regarding a pet and identify a first set value from a set value corresponding to the pet based on the obtained information;

obtain a first event for entering a pet mode, wherein the first event occurs based on only the pet being in a house by analyzing an image received from a camera located in the house;

based on the air conditioner entering the pet mode according to the first event, determine the first set value from the set value corresponding to the pet based on the obtained information, and control a set value of the air conditioner according to the first set value;

receive a first user input for controlling the air conditioner while the air conditioner operates according to the first set value in the pet mode;

operate by changing the set value of the air conditioner to a second set value according to the received user input;

determine whether a number of times of input of the first user input exceeds a threshold value;

based on the number of times of input of the first user input exceeding the threshold value update the set value corresponding to the pet from the first set value to the second set value, end the pet mode based on a second user input;

obtain the first event for entering the pet mode after ending the pet mode; and based on the air conditioner entering the pet mode according to the first event, control the set value of the air conditioner according to the second set value.

12. The non-transitory computer readable medium of claim 11, wherein:

the first set value is a set value for setting a set humidity, a set temperature, and an operating mode of the air conditioner according to the information regarding the pet, and the first user input is a user input for changing at least one of the set humidity, the set temperature, and the operating mode of the air conditioner.

13. The non-transitory computer readable medium of claim 11, further comprising instructions that when executed by the processor cause the air conditioner to:

receive the information regarding the pet input via a first user interface (UI) displayed on a user device, wherein the information regarding the pet comprises at least one of a type, a breed, a size, and a hair length of the pet.

* * * * *